US005303955A

United States Patent [19]

Zurnamer

[11] Patent Number: 5,303,955

[45] Date of Patent: Apr. 19, 1994

[54] IN-LINE ROLLER SKATE GUARD

[75] Inventor: Kal G. Zurnamer, Manhattan Beach, Calif.

[73] Assignee: Manhattan Beach Blading Company, Los Angeles, Calif.

[21] Appl. No.: 22,193

[22] Filed: Feb. 25, 1993

[51] Int. Cl.[5] ..... A63C 3/12

[52] U.S. Cl. ..... 280/825; 36/132

[58] Field of Search ..... 280/825, 811, 809; 36/132, 134, 136

[56] References Cited

U.S. PATENT DOCUMENTS

| | | | |
|---|---|---|---|
| 4,355,474 | 10/1982 | Grim | 280/825 |
| 4,546,999 | 10/1985 | Lehr | 280/825 |
| 5,183,292 | 2/1993 | Ragin, III | 36/132 |

OTHER PUBLICATIONS

Inline Retailer Magazine, Sep. 1992, "Walk-Abouts", p. 25.

Rollerguard, Inc., 2 page flier titled "Roller Guard—In-line Walk and Roll", dated Jul. 15, 1992.

*Primary Examiner*—Margaret A. Focarino
*Assistant Examiner*—Kevin Hurley
*Attorney, Agent, or Firm*—Thomas M. Freiburger

[57] ABSTRACT

A roller wheel guard for in-line roller skates, is formed of an envelope-shaped body of flexible material such as woven nylon, open at the top, with a rubbery bottom. The envelope-like body receives the series of aligned wheels and extends up to just below the boot of the skate. Side panels of the guard have rear extensions forming at least one strap to be wrapped tightly around the rearmost wheel or the brake when the guard is installed. A further, vertical strap is included, secured to the body and of an adjustable length so as to extend to the top of the back edge of the boot, with an attachment such as a clip for securing to the back of the boot, thus forming a handle when the guard is in place. Preferably a pull ring is included on the strap, enabling the user to pull upward on the back of the wheel guard body, to tightly position the guard over the wheels when installed and to adjust the length of the vertical strap to accommodate the particular size of wheel assembly.

22 Claims, 3 Drawing Sheets

IN-LINE ROLLER SKATE GUARD

BACKGROUND OF THE INVENTION

The invention relates to roller skating apparatus, and more specifically to a guard or cover for the wheels of an in-line roller skate. The wheel cover acts as a protective device when the skates are not being used, keeping moisture or dirt out of the wheels and wheel bearings, and serves as a stabilizing support for walking on inclines or steps when the skates are being worn.

In-line roller skates are a relatively recent development and have assumed much of the popularity of traditional roller skates. The in-line rollers or wheels in part act to simulate ice skating.

One problem encountered by in-line roller skate users is the problem of going up inclines or up or down steps. The wheels make the user unstable in these and related situations.

In addition, when a set of in-line roller skates are not in use, it is sometimes desirable to cover the wheels because of accumulated dirt, dust and grit and also to protect the wheels and wheel bearings during periods of non-use.

It is an object of this invention to provide a solution to both of the above problems with in-line roller skating, through a guard and cover device which both protects the wheels and wheel bearings and can be worn on the skates when steps, inclines or similar situations are to be negotiated, as well as providing a carrying means for the skates.

SUMMARY OF THE INVENTION

In-line roller skate covers in one preferred embodiment of the invention are each in the form of an envelope-like body which receives the set of wheels and the associated wheel mounting frame from above, via an open upper side. Preferably the rear is also open, and a front seam or edge of the flexible body is inclined upwardly and rearwardly, so as to grip over the front wheel when the wheels are pushed forward into the envelope-like enclosure. In the preferred embodiment a pair of side panels of the envelope-like body terminate at the rear in one or a pair of rear straps, which are to be wrapped over the rear wheel of the set of wheels after they have been placed in the enclosure (or over the brake if present on one skate). A further, thin strap extends from the bottom of the envelope-like body at the rear, and is effective when pulled up to tighten the wheel cover over the wheels by pulling the cover tightly back against the wheel assembly. In addition, a hook or other fastener preferably is included at the outer end of this thin strap, for securing to the back of the boot of the skate, for example at the top edge of the boot. This provides a carrying strap for the skate.

The invention also encompasses an in-line skate wheel cover wherein a closure is formed at the front of the cover. This can be a better arrangement, for example, for five wheel in-line roller skates having a brake, where the rear of the brake might extend back perhaps four inches behind the boot or shoe. In that case, the back of the cover can be closed, but with a hole to fit over the brake. A closure of appropriate form, such as one or more straps, can be provided at the front of the wheel guard.

In preferred embodiments the envelope-like cover body can be formed of a tough, strong, flexible material, such as, for example, woven Cordura nylon. To facilitate the use of the covers when the skates are being worn, the bottom surface of each cover can have a rubbery material or otherwise be reinforced with a high-friction material so as to enable walking on pavement or other abrasive surfaces without abrading through the cover.

It is therefore a principal object of the invention to provide an efficiently used wheel cover for in-line roller skates, having the multiple purposes of facilitating walking up or down steps or inclines when the skates are worn, protecting the wheels and bearings from dirt and dust, covering the wheels to contain dust or grit so as to enable packing the skates in luggage or similar situations, and providing a convenient carrying strap for each skate. These and other objects, advantages and features of the invention will be apparent from the following description of a preferred embodiment, considered along with the accompanying drawings.

DESCRIPTION OF THE PREFERRED EMBODIMENTS

Figure 1:
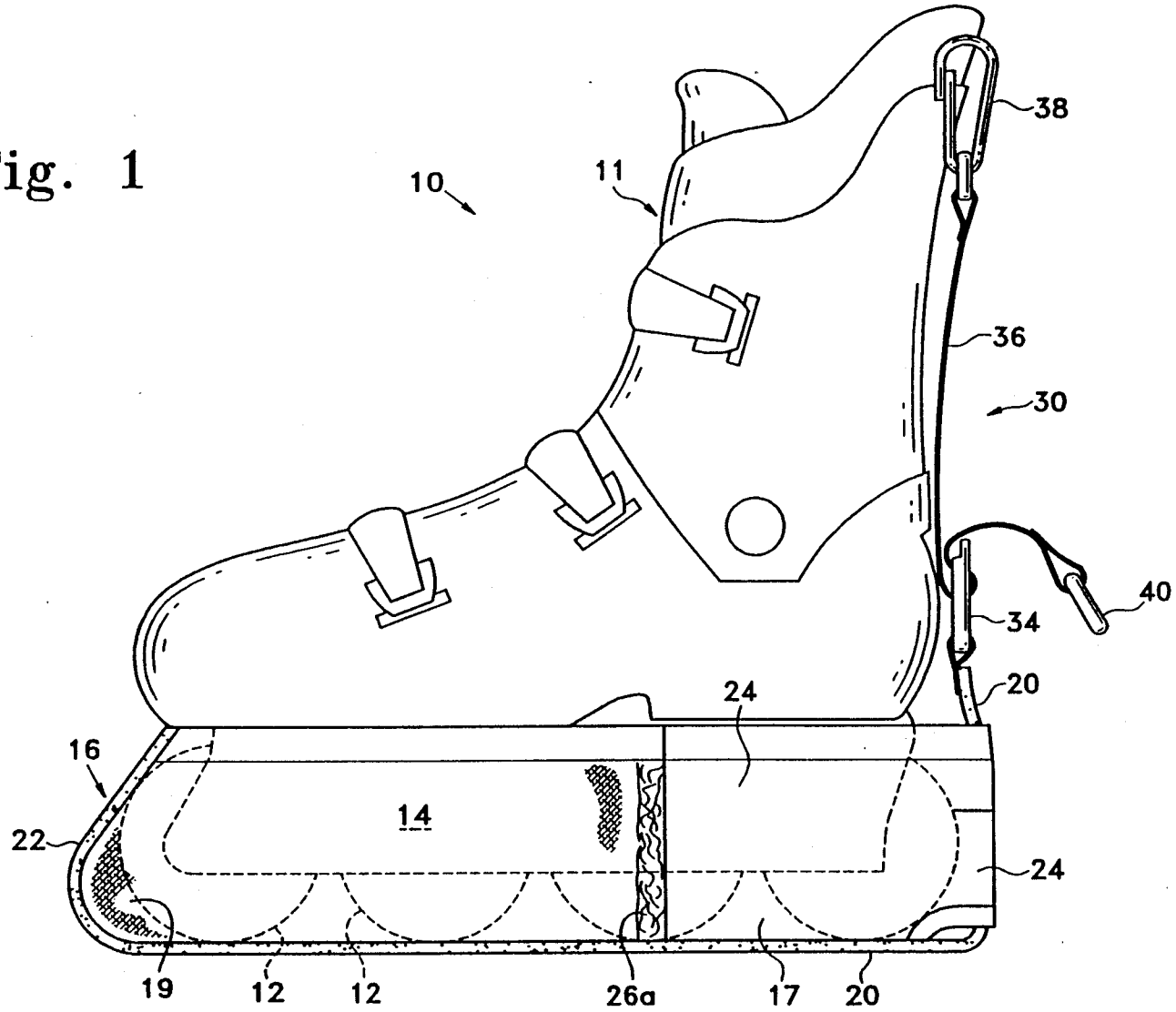
FIG. 1 is an elevation view showing an in-line roller skate fitted with a wheel cover in accordance with the invention.

FIG. 1 shows an in-line roller skate 10 having a shoe or boot 11, a set of wheels 12 (dashed lines) and a wheel mounting frame 14 (dashed lines) secured to the bottom of the boot 11. The skate 10 is fitted with a wheel cover 16 according to one preferred embodiment of the invention, comprising an envelope-like body 17 having an open top and having a pair of generally parallel right and left side panels 18 and 19. See also FIGS. 2 and 3. These side panels, which may be of a tough and flexible material such as woven nylon, are secured to a bottom strip 20 of rubber or rubber-like high-friction synthetic material. This connection may be by glue, stitching or other permanent, strong attachment, or a combination of stitching with adhesion, for example. The side panels preferably are formed of a single piece of material, continuous across the bottom over the top of the bottom strip 20. The rubber bottom strip 20 preferably extends forward to wrap up and around the front of the body, as a rubbery front edge 22. As discussed previously, this front edge 22 preferably is inclined upwardly/rearwardly as shown, and may be curved for a smooth transition and to very generally conform to the contour of the front edge of the forward wheel 12 (shown in dashed lines) when the wheel is tightly engaged therein. Thus, to install the cover on the set of skate wheels, the series of wheels are positioned down into the open top of the envelope-like cover 16, and pushed forward as much as possible to engage the forward wheel against the interior of the inclined front edge. This is schematically indicated in FIG. 4.

Right and left rear straps or horizontal straps 24 and 26 serve to complete the enveloping of the wheels and the wheel mounting frame 14 which secures them to the boot 11, comprising extensions of the side panels. A single horizontal strap could be provided if desired (or even a different type of closure, preferably adjustable), but this preferred embodiment includes a pair of these straps to enable a greater versatility in accommodating different lengths of wheel assemblies as well as to provide a secure closure. As indicated in the schematic views of FIGS. 4, 5 and 6, after one strap 26 has first been brought around the rearmost wheel 12 and tucked against the opposite side of the wheels, interiorly of the side panel 18 on the opposite side, the panel 18 is pushed into contact with this tucked strap, and the remaining strap 24 is brought around the outside and is pulled and wrapped tightly and secured against the outside of the opposite side panel 19. See FIGS. 1, 2 and 3. The connection is preferably made by a Velcro-like material, i.e. hook and loop fasteners 24*a* and 26*a*, with the outer strap 24 preferably carrying the hook fasteners 24*a* on its inside surface. As can be envisioned from the drawings, the hook and loop fasteners on the two straps 24 and 26 provide for considerable latitude in the total length of wheels or wheels and brake that can be covered by the guard 16.

It is common for a pair of in-line roller skates to have a rear brake on one skate, which adds to the length of that one skate wheel assembly. The drawings herein show only a skate with no brake. Because of the considerable difference in lengths of wheel assemblies with and without a brake, a pair of wheel covers in accordance with this invention can include one cover which is somewhat longer than the other, to accommodate the brake. This is preferable to relying on the horizontal straps alone for adjustability. Also, as noted above, five-wheel skates with brakes are very long and extend back considerably from the boot. For such skates the guards closure may be different; a front closure (one or two straps or another effective closure) can be provided, with the rear end of the cover closed. A hole can be present at the rear to slip over a brake.

Figure 2:
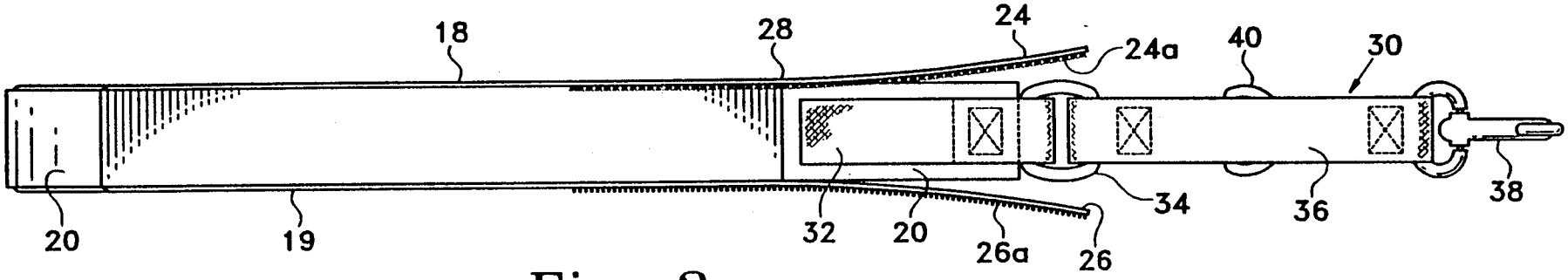
FIG. 2 is a top plan view of the wheel cover itself.
Figure 3:
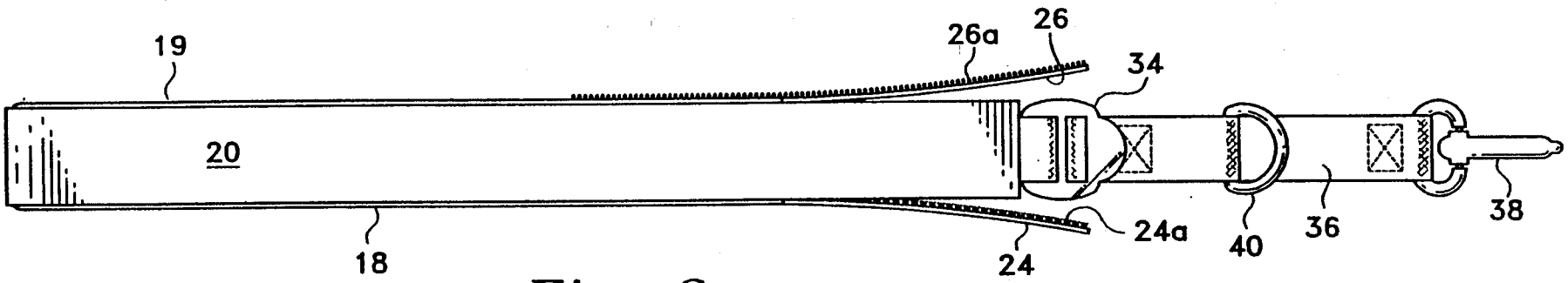
FIG. 3 is a bottom plan view of the wheel cover.
Figure 4:
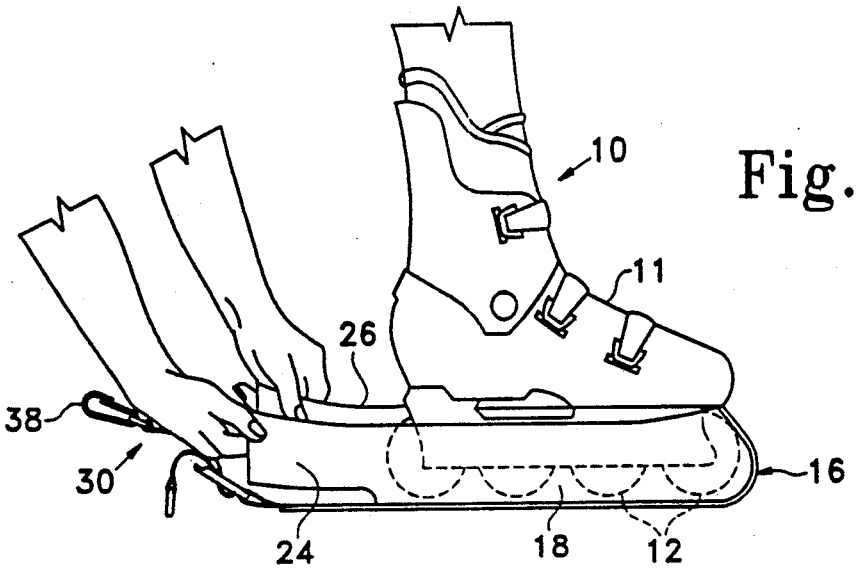
FIGS. 4, 5 and 6 are a series of schematic views in side elevation indicating the manner of installation of the wheel cover on a skate.
Figure 5:
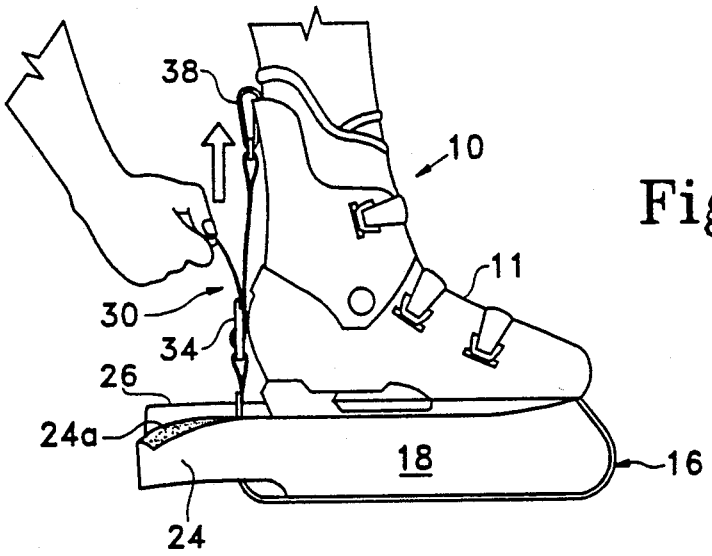
Figure 6:
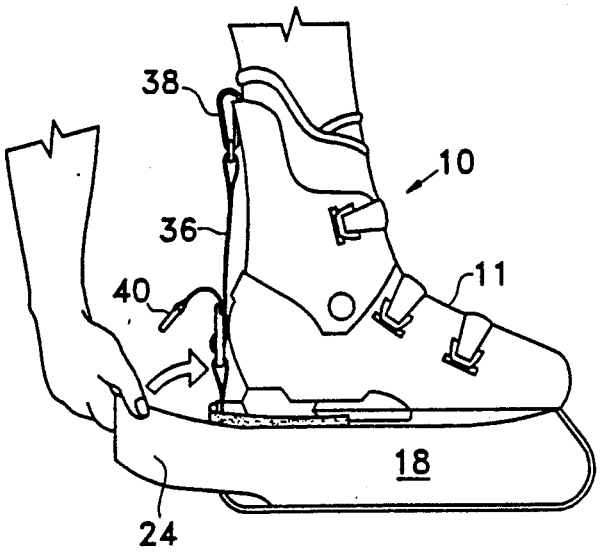

As shown particularly in FIGS. 1, 2 and 3, and also in the schematic views of FIGS. 4, 5 and 6, the rubbery bottom strip 20 preferably extends back from the point 28 (FIG. 2) where the straps 24 and 26 extend freely from the side panels 18 and 19, to a termination just short of the length of the horizontal straps 24 and 26. This is shown particularly in FIGS. 2 and 3. This length of the rubber bottom strip 20 helps accommodate wheel assemblies of varying length, with the excess length, if any, simply being drawn upwardly around the back of the rear most wheel 12, as shown in FIG. 1 as well as FIGS. 5 and 6.

As shown particularly in FIG. 2, a thinner, vertical strap 30 is securely affixed to the rear extension of the rubber bottom strip 20, having the function of assisting in pulling the envelope-like enclosure body 17 firmly around the wheel assembly and the additional function of providing a carrying strap when the in-line roller skates 10 are not in use. The strap 30 includes a base portion 32 which is secured to the rubber extension 20, a "ladder" adjustment device 34, preferably of plastic, an upper strap portion 36 and a connection device 38 at the outer or upper end of the strap, which may be a snap hook as shown. The "ladder" 34 is a well known type of strap adjustment device. As indicated in FIGS. 1, 2, 3 and 5, a ring (preferably of plastic) 40 at one end of the strap portion 36 can be pulled upwardly after the hook 38 is engaged over the top edge of the boot, to adjust the length and tension of the strap 30/rubbery strip 20 assembly to secure the wheel cover 16 firmly in place on the skate 10.

The overall cover assembly 16 is very flexible and, when not in use, can be compactly rolled and stored. The two side panels 18, 19 and the extending strap or straps 24, 26 can be folded inward over the bottom strip, and the assembly can then be tightly rolled up, from the front. The vertical strap 30 can be wrapped around the outside of the compact roll. Rolled in this way, a wheel guard 16 can easily be carried in a garment pocket.

FIGS. 4, 5 and 6 indicate in schematic views the procedure for installing the wheel cover 16 of the invention. In FIG. 4 the wheel cover 16 has been placed over the wheels, with the forward wheel extending against the inside front of the cover 16. The two straps 24 and 26 are positioned to extend freely out toward the rear, and can be pulled to assure that the cover is relatively snugly in place. As shown in FIG. 5, the next step is to engage the clip or hook 38 over the top edge of the boot 11 (or onto any ring or other device provided on the back side of the boot 11). Then the pull ring 40 is grasped in the hand and pulled up, to more firmly engage the envelope-like body of the wheel cover about the skate wheels, while pulling up on the tail end of the rubbery bottom strip 20 and establishing a small amount of tension in the strap 30 by adjustment via the "ladder" adjustment device 34, enough tension to firmly retain the wheel guard on the skate 10.

Next, the strap 26 having the exteriorly mounted hook or loop fastener materials, which is the left horizontal strap in the arrangement shown, is pulled around the rubber strip at the back of the rear wheel and tucked between the wheels and the opposite side panel 18 (this step is not specifically shown). The outer strap 24 is then brought tightly around the inner strap and engaged, via the hook and loop fasteners in this preferred embodiment.

The above described preferred embodiments are intended to illustrate the principles of the invention but without limiting its scope. Other embodiments and variations to these preferred embodiments will be apparent to those skilled in the art and may be made without departing from the essence and scope of the invention as defined in the claims.

I claim:

1. A wheel cover for an in-line roller skate having a series of in-line wheels, a wheel mounting frame and a boot above the wheels and secured to the frame, comprising:

a flexible generally envelope shaped cover body having left and right side panels, a bottom secured to the side panels and an open top, of a size to receive a series of skate wheels at the base of an in-line roller skate, securing means for closing the two side panels of the flexible body together so as generally to envelop the series of skate wheels, to a level below the boot of the skate, and a vertical strap connected to the back of the flexible body and having an upper end with clip means for connecting to the back of the boot portion of the skate, whereby, with the wheel cover installed on a pair of in-line roller skates, a wearer can safely walk on inclines or steps, and when not wearing the skates, a user can carry the skates via the vertical strap of each cover.

2. The apparatus of claim 1, wherein the two side panels of the flexible body are permanently connected at a front end, and wherein at least one side panel extends rearwardly to define at least one closure strap, having engagement means for securing the opposite side panel when the closure strap is pulled tightly around the back of the skate, the strap and engagement means serving as said securing means.

3. The apparatus of claim 2, wherein the front end of the flexible body comprises a front rearwardly inclining strip to which the side panels are secured, forming a pocket which engages over a front wheel of the series of wheels in a manner such as to lock onto the series of wheels when the closure strap is pulled back and engaged via the engagement means.

4. The apparatus of claim 3, wherein the bottom comprises a rubbery strip extending essentially the length of the flexible cover body, and wherein the front rearwardly inclining strip comprises an extension of the rubbery bottom strip, curving up and back at the front.

5. The apparatus of claim 4, wherein the two side panels are formed of a single piece of woven synthetic material which is continuous across the bottom of the envelope shaped cover body, the rubbery bottom strip being secured at the bottom side of the piece of material.

6. The apparatus of claim 5, wherein the woven synthetic material comprises woven nylon.

7. The apparatus of claim 1, wherein the bottom comprises a rubbery strip, with the left and right side panels secured to the upper side of the rubbery strip.

8. The apparatus of claim 7, wherein the vertical strap is secured to the back end of the rubbery strip.

9. The apparatus of claim 1, wherein the securing means comprises at least one closure strap extending from one end of one of the side panels with the opposite ends of the side panels being connected together, and the strap including the engagement means comprising hook and loop fasteners, with one type of the hook and loop fasteners being on the outside of one of the side panels and the other type of hook and loop fasteners being on the inside of the closure strap, such that the hook and loop fasteners are positioned to be engaged together, at adjustable positions, when the strap is pulled around the skate and secured against said one side panel.

10. The apparatus of claim 1, wherein the securing means comprises a pair of horizontal closure straps, one extending from each of the side panels, such that one of the closure straps can be brought around the end wheel of the skate and tucked against the opposite side of the wheels, and the other horizontal closure strap can then be wrapped around the one closure strap and engaged against the outside of said one closure strap and against the outside of the side panel from which said one closure strap extends, and including surface engagement means for engaging and locking the closure straps together.

11. The apparatus of claim 10, wherein the engagement means comprises hook and loop fasteners.

12. The apparatus of claim 1, wherein the vertical strap has a hook at its upper end, serving as said clip means with the boot.

13. The apparatus of claim 12, wherein the vertical strap includes adjustment means for enabling adjustment of the length of the strap.

14. The apparatus of claim 13, wherein the vertical strap further includes a loop positioned for grasping by the user's finger, so as to effect adjustment of the strap via said adjustment means when the loop is pulled up, so as to tightly secure the flexible body on the skate wheels.

15. The apparatus of claim 1, wherein each of the side panels extends rearward of the skate wheels so as to form securing straps, one strap being insertable around the opposite side of the skate wheels and within the envelope of the flexible body, and the opposite strap having surface engagement means for adjustably securing onto the outside of said one strap and the associated side panel, the side panels being connected at the front of the wheel cover.

16. The apparatus of claim 15, wherein the surface engagement means comprises hook and loop fasteners.

17. A wheel cover for an in-line roller skate having a series of in-line wheels, a wheel mounting frame and a boot above the wheels and secured to the frame, comprising:

a flexible generally envelope shaped cover body having left and right side panels, a bottom secured to the side panels and an open top, of a size to receive a series of skate wheels at the base of an in-line roller skate, and securing means for closing the two side panels of the flexible body together so as generally to envelop the series of skate wheels, whereby, with the wheel cover installed on a pair of in-line roller skates, a wearer can safely walk on inclines, steps or similar situations.

18. The apparatus of claim 17, wherein the two side panels of the flexible body are permanently connected at a front end, and wherein at least one side panel extends rearwardly to define at least one closure strap, having engagement means for securing to the opposite side panel when the closure strap is pulled tightly around the back of the skate, the strap and engagement means serving as said securing means.

19. The apparatus of claim 18, wherein the front end of the flexible body comprises a front rearwardly inclining strip to which the side panels are secured, forming a pocket which engages over a front wheel of the series of skate wheels in a manner such as to lock onto the series of wheels when the closure strap is pulled back and engaged via the engagement means.

20. The apparatus of claim 17, wherein the bottom comprises a rubbery strip, with the left and right side panels secured to the upper side of the rubbery strip.

21. The apparatus of claim 17, wherein each of the side panels extends rearward of the skate wheels so as to form left and right securing straps, one strap being insertable around the opposite side of the roller wheels and within the envelope of the flexible body, and the opposite strap having surface engagement means for securing onto the outside of said one strap and the associated side panel, serving as said securing means.

22. The apparatus of claim 7, wherein the securing means comprises at least one closure strap extending from one end of one of the side panels with the opposite ends of the side panels being permanently connected together, and the closure strap including surface engagement means for securing onto the outside of the opposite side panel after the strap is pulled around the end of the skate.

* * * * *